US005613487A

United States Patent [19]

Hawkinson

[11] Patent Number: 5,613,487

[45] Date of Patent: Mar. 25, 1997

[54] FIREPLACE DOOR LATCH SYSTEM

[75] Inventor: Eric Hawkinson, Mt. Pleasant, Iowa

[73] Assignee: Hon Industries Inc., Muscatine, Iowa

[21] Appl. No.: 585,730

[22] Filed: Jan. 16, 1996

[51] Int. Cl.[6] ..... F24C 3/00

[52] U.S. Cl. ..... 126/512; 110/173 B; 126/197

[58] Field of Search ..... 126/512, 192, 126/190, 200, 92 AC, 92 R, 285 R, 116 R, 293, 197; 110/173 B, 173 R, 181, 176

[56] References Cited

U.S. PATENT DOCUMENTS

| | | | |
|---|---|---|---|
| 927,240 | 7/1909 | Hoffman | 110/173 B |
| 1,101,094 | 6/1914 | Rieber | 110/173 B |
| 1,944,156 | 1/1934 | Feltham | 110/173 B |
| 5,029,533 | 7/1991 | Hengelmolen | 110/173 B |
| 5,307,801 | 5/1994 | Schroeter et al. | 126/512 |

*Primary Examiner*—James C. Yeung
*Attorney, Agent, or Firm*—Jones, Day, Reavis & Pogue

[57] ABSTRACT

A gas-fired fireplace comprises an enclosure having a forwardly facing glass panel. The panel is pivotably secured to the enclosure along a lower edge of the panel. The upper edge of the panel is normally spring biased against the enclosure by a latch mechanism. By this arrangement an explosion within the fireplace combustion chamber will cause the panel to pivotably open and relieve the pressure within the chamber. The panel can also be readily removed without tools if it is necessary to gain access to the inside of the fireplace.

7 Claims, 3 Drawing Sheets

FIREPLACE DOOR LATCH SYSTEM

BACKGROUND OF THE INVENTION

1. Field of the Invention

The present invention relates generally to a latch system for a fireplace door and, more particularly, to a door latch which will permit a door of a gas-fired fireplace to open and relieve an explosion in the fireplace in the event of an accidental failure of the fireplace ignition system.

2. Description of the Prior Art

Factory-built fireplace assemblies have long been available as both free-standing and wall recessed units. One popular form of a fireplace functions as a room heater and comprises a combustion chamber surrounded by an enclosure providing a passageway for circulating room air over the combustion chamber. Heated air may thereby be circulated into the room either by gravity or by use of a blower system. This type of fireplace is preferably fired with natural or LP gas and has ceramic or cement artificial logs simulating the appearance of a wood burning fireplace while offering the advantage of efficiently converting the natural or LP gas to room heat.

A common design of a gas-fired fireplace is of a construction known as the direct-vent type. In this construction, the combustion chamber is fabricated as a sealed enclosure and is vented by a concentric pipe arrangement in which flue gases are exhausted through a central pipe while intake air is drawn into the combustion chamber through an annular space defined by an outer larger diameter pipe. Such a fireplace construction has become popular because the cooling effect on the central exhaust pipe by the intake air allows the fireplace to be vented without costly masonry chimney construction. Accordingly, the direct-vent, gas-fired fireplace has gained wide acceptance in modern building architecture.

In a standard design of the direct-vent, gas-fired fireplace, the combustion chamber is sealed at its front face by a glass panel. The glass panel serves to enclose the combustion chamber while allowing the fire to be viewed by the occupants of the room. However, a failure in the ignition system of the fireplace could cause excess accumulation of gas within the combustion chamber which, if ignited, could in turn cause a combustion chamber explosion. Such an explosion could pose a safety hazard to the room occupants if the glass fireplace front were to shatter. Accordingly, it is common in fireplace design to use explosion relief panels in the metal enclosure of the combustion chamber. These panels are essentially designed to blow out under the pressure of an explosion and relieve the combustion chamber pressure without breaking the glass front.

A disadvantage of present fireplace construction using explosion relief panels in the combustion chamber is that in the event the panels are blown out by an explosion, it is a very labor-intensive job to repair the fireplace. Particularly, in typical cases in which the fireplace is a wall-recessed unit, the entire fireplace must be disassembled and removed from the wall to gain access to the relief panels. Generally, another disadvantage of common fireplace construction is that the frontal glass panel is mechanically secured to the fireplace enclosure by screws and other hardware making it time consuming to gain access to the interior of the enclosure in the event that maintenance of the fireplace needs to be performed.

Accordingly, it is desirable to provide a fireplace assembly in which explosion relief panels need not be constructed in the combustion chamber to relieve internal pressure from a possible gas explosion. It is further desirable to provide a fireplace assembly in which the typical front glass panel is readily removable, without the need for tools of any kind when access to the interior of the fireplace is necessary.

SUMMARY OF THE INVENTION

The present invention overcomes the disadvantages of the prior art by providing a gas-fired fireplace wherein the fireplace has a forwardly facing glass panel secured to an enclosure. The panel is secured to the enclosure at the lower edge of the panel by a channel member which allows the panel to pivot slightly relative to the enclosure and provide an opening to the fireplace combustion chamber adjacent the upper edge of the panel. The upper edge of the panel is normally biased against the enclosure by a spring latch mechanism. By this arrangement, an explosion within the combustion chamber will cause the panel to pivotably open and relieve the pressure within the chamber. The panel can also be readily removed without tools if it is necessary to gain access to the inside of the fireplace.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENT

Figure 1:
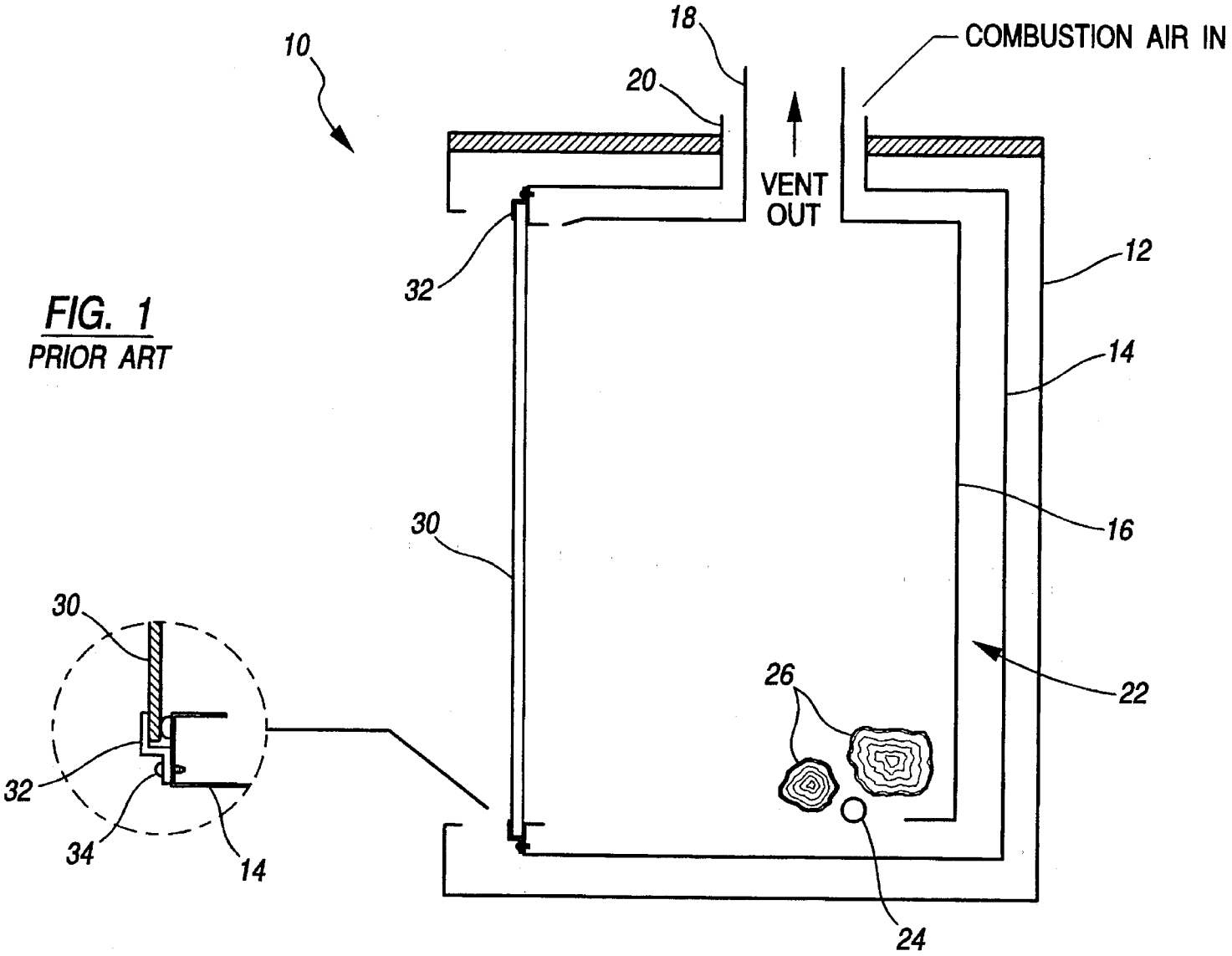
FIG. 1 PRIOR ART
FIG. 1 is a side schematic view of a fireplace assembly constructed according to the prior art and illustrating a conventional mounting arrangement for a frontal glass panel.

Referring now to the drawings, and initially to FIG. 1, a prior art gas-fired fireplace of the direct-vent type is designated generally by the reference numeral 10. This fireplace 10 is designed with an outer enclosure 12, an inner firebox enclosure 14 and a combustion chamber enclosure 16. The combustion chamber is vented through an exhaust vent 18 which is typically a round vent pipe disposed concentrically with a round air intake pipe 20. A passageway 22 formed between the combustion chamber enclosure 16 and the enclosure 14 conducts intake air to the bottom of the combustion chamber enclosure 16 wherein a suitable burner 24 supplies gas for combustion. Artificial logs 26 may be provided to simulate the appearance of a natural wood fire.

In order to provide for viewing of the fire within the fireplace 10, the front of firebox enclosure 14 is fitted with a glass panel 30. A typical prior art assembly 10 has the panel 30 mounted to the firebox 14 by upper and lower channel brackets 32 which are attached to the firebox 14 by a plurality of sheet metal screws 34 running lengthwise of the channel brackets 32. By this construction, the panel 30 is rigidly secured to the firebox 14 and, to avoid shattering the panel 30 in the event of a gas explosion within the combustion chamber 16, explosion relief panels (not shown) are preferably provided in one or more walls of the combustion chamber 16.

Figure 2:
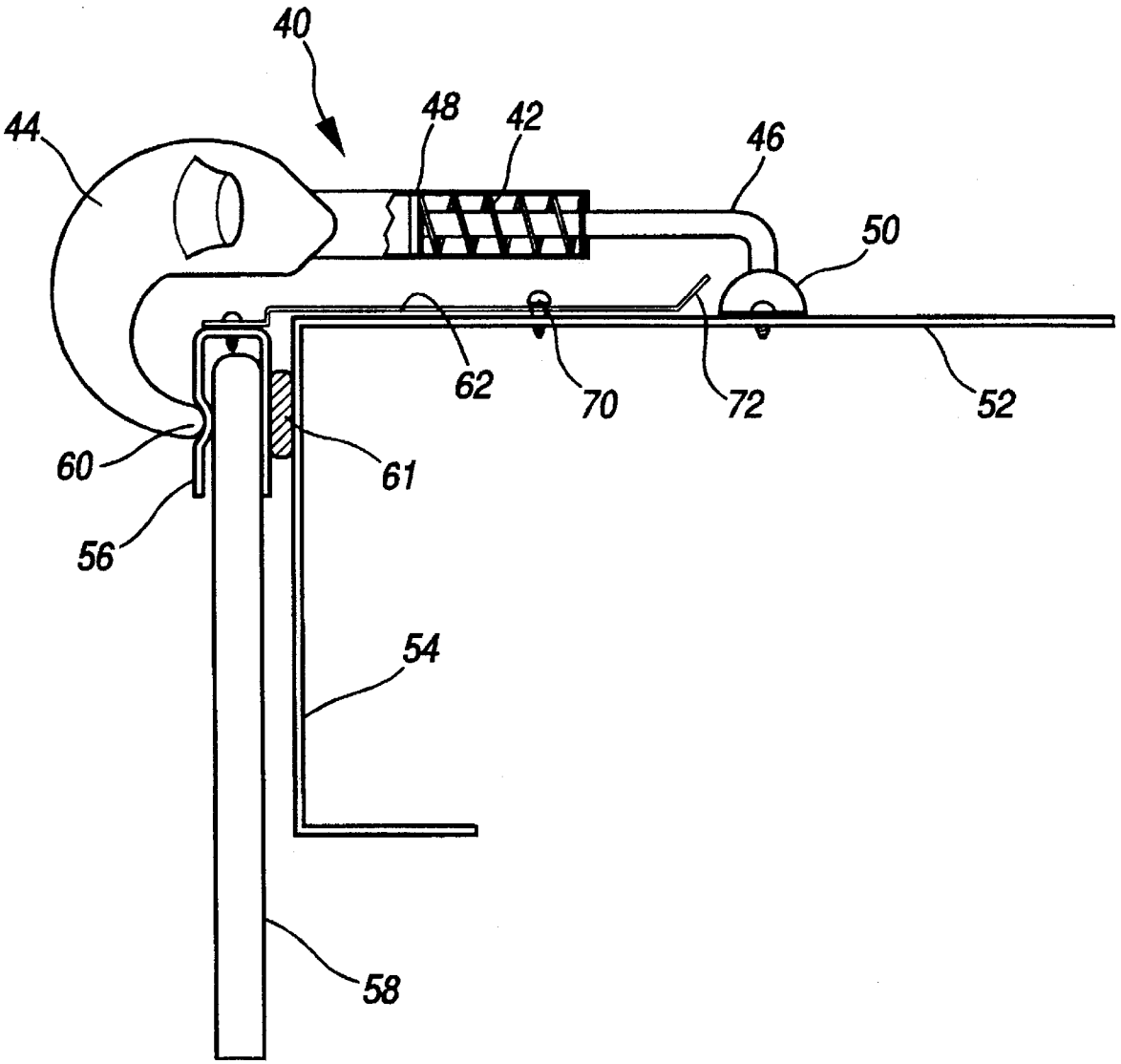
FIG. 2 is a side schematic view of a latch assembly for latching a frontal fireplace panel in accordance with the principles of the invention.

Turning now to FIG. 2, a door latch system constructed in accordance with the invention includes as a principal component a latch assembly 40 having an internal compression spring 42 and a forward hook member 44. A rod 46 bent at a right angle is attached at one end to a plunger 48 which engages the spring 42 and is secured by a swivel 50 to a top wall 52 of the fireplace firebox. The hook member 44 is dimensioned and configured to extend around a front wall 54 of the firebox and engage a frame 56 in which a front glass panel 58 is mounted. A suitable detent 60 is provided in the frame 56 to positively locate the hook member 44. A seal gasket 61 is preferably provided to seal the frame 56 to the front wall 54 of the firebox thus providing for a sealed combustion chamber.

Figure 3:
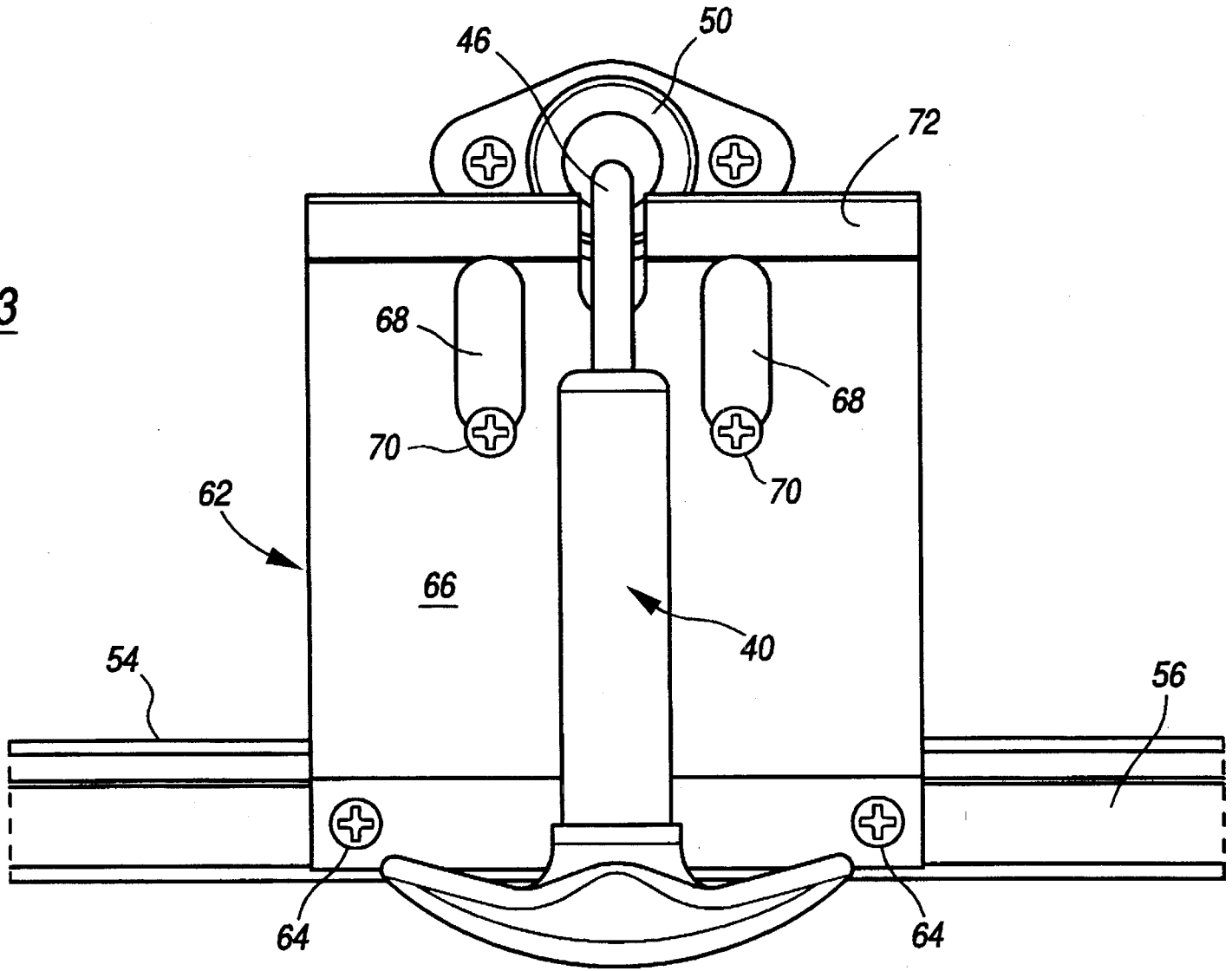
FIG. 3 is a top plan view of a latch assembly in accordance with the invention.

In order to provide for stability of the glass panel 58, and also the latch assembly 40, as best seen in FIG. 3 a stop bracket 62 consisting of a formed sheet metal member is secured to the panel frame 56 by suitable means such as sheet metal screws 64. The bracket 62 has a generally flat, planar intermediate portion 66 in which a pair of slots 68 are formed. The slots are dimensioned to receive heads of pins 70 which are preferably screwed into the top wall 52 of the firebox. An upwardly turned flange 72 is formed on the end of the bracket 62. The panel 58 may be secured to the firebox at its lower edge by a channel bracket similar to the bracket 32 shown in FIG. 1.

The operation of the latch system can now be appreciated with reference to FIGS. 2 and 3. In the event of a gas explosion in the combustion chamber of the fireplace as might occur upon a failure of the fireplace ignition system, built-up pressure in the combustion chamber will act on the front panel 58 of the firebox enclosure and will cause the panel 58 to pivot away from the front wall 54 of the firebox against the opposing force of the compression spring 42 of the latch assembly 40. This opening of the panel 58 will serve to relieve the pressure within the combustion chamber thereby avoiding the need for any pressure-relief panels constructed in the combustion chamber itself. The pivoting action of the panel 58 can be provided even using a prior art type channel bracket 32 securing the panel 58 along its lower edge. The bracket 32, in such case, is designed to hold the panel 58 firmly to the firebox while having sufficient resilience to bend slightly should the panel 58 be forced open at its top. The panel 58 need only open a few inches at the top to relieve an explosion. Hence, the bending of the bracket 32 would only be very minor.

An important feature of the invention is the provision of the stop bracket 62 with the slots 68 of the bracket 62 guided by the pins 70. As the panel 58 opens at its top, the bracket 62 will move outwardly with the panel 58 until the heads of the pins 70 engage the flange 72 of the bracket 62. Such engagement will serve as a positive stop restricting the opening of the panel 58 to only a predetermined amount. Thus, the bracket 62 serves to stabilize the panel 58 during sudden opening as would occur upon a combustion chamber explosion. The bracket 62 also serves to avoid bottoming of the spring 42 of the latch assembly 40 and thereby jarring the panel 58. Thus the latch assembly provides a highly effective means for relieving a gas explosion without damaging the combustion chamber and requiring considerable labor to repair.

In another aspect of the invention, it can be appreciated that the latch system provides a very convenient means for removal of the fireplace panel 58 in the event that access to the fireplace interior is needed. In such an event, the latch assembly 40 may simply be disengaged from the panel frame 56 with the hook member 44 turned out of the way. Then, the panel can be tilted forward and the stop bracket 62 can be pried upwardly such that the heads of the pins 70 clear the slots 68, allowing the flange 72 to pass over the pins 70. The panel 58 then is free to be lifted out of the lower channel bracket 32 and be completely removed from the fireplace. Such an operation can simply be performed manually, without the need for tools of any kind. Thus, the latch system provides for considerable savings in labor where a maintenance procedure needs to be performed on the fireplace. While one latch assembly 40 and associated stop bracket 62 has been illustrated herein, in practice it is preferred to use three latches 40 and brackets 62 in a conventional fireplace construction with the latches 40 suitably spaced along the top of the front panel. The use of multiple latches 40 and brackets 62 provides for proper distribution of the forces acting on the panel during a sudden explosion. Of course the spring force of the latches 40 is selected such that the latches readily function within the strength limitations of the glass panel 58 and, thereby shattering of the panel 58 will not occur as a result of excessive latch 40 force.

While the present invention has been described in connection with a preferred embodiment thereof, it will be apparent to those skilled in the art that many changes and modifications may be made without departing from the true spirit and scope of the present invention. Accordingly, it is intended by the appended claims to cover all such changes and modifications as come within the true spirit and scope of the invention.

What is claimed is:

1. A fireplace assembly of the gas-fired type comprising:

an enclosure having a combustion chamber internal thereto;

a gas burner assembly disposed within said combustion chamber;

a glass panel fixed to a front of said enclosure and providing means for viewing the combustion chamber, said panel having an upper and a lower edge;

means for pivotably securing the lower edge of said panel to said enclosure; and means for resiliently biasing the upper edge of said panel against said enclosure, said biasing means including at least one latch assembly fixed at a first end to said enclosure and having a hook at a second end which engages said glass panel;

wherein said panel forms an opening adjacent to the upper edge of said panel by pivoting on said pivotably securing means when an explosion occurs in said combustion chamber.

2. The fireplace assembly of claim 1 wherein said hook engages a detent in a frame of said glass panel.

3. The fireplace assembly of claim 1 wherein said first end of said latch assembly is swivelably secured to said enclosure.

4. A fireplace assembly of the gas-fired type comprising:

an enclosure having a combustion chamber internal thereto;

a gas burner assembly disposed within said combustion chamber;

a glass panel fixed to a front of said enclosure and providing means for viewing the combustion chamber, said panel having an upper and a lower edge;

means for pivotably securing the lower edge of said panel to said enclosure;

a stop bracket secured at one end to said glass panel and provided at a second end with means for reciprocating attachment to said enclosure; and means for resiliently biasing the upper edge of said panel against said enclosure;

wherein said panel forms an opening to said enclosure adjacent to the upper edge of said panel by pivoting on said pivotably securing means when an explosion occurs in said combustion chamber.

5. The fireplace assembly of claim 4 wherein said attachment means includes at least one slot formed in said bracket for cooperation with a pin fixed to said enclosure.

6. The fireplace assembly of claim 5 wherein said bracket further includes a flange and said pin engages said flange to limit reciprocating movement of said bracket relative to said enclosure.

7. The fireplace assembly of claim 4 wherein said stop bracket is disposed on said enclosure beneath said biasing means.

* * * * *